United States Patent [19]

Brown

[11] 4,341,028

[45] Jul. 27, 1982

[54] VISIBLE INFORMATION MANAGEMENT SYSTEM

[76] Inventor: Keith Brown, 8116 Kenova La., Springfield, Va. 22153

[21] Appl. No.: 260,753

[22] Filed: May 5, 1981

[51] Int. Cl.[3] ..... G09F 19/00

[52] U.S. Cl. ..... 40/534; 40/11 R

[58] Field of Search ..... 40/124, 606, 607, 617, 40/534, 11, 533

[56] References Cited

U.S. PATENT DOCUMENTS

| | | | |
|---|---|---|---|
| 855,462 | 6/1907 | La May | 40/124 |
| 880,611 | 3/1908 | Wermerskirchen | 40/533 |
| 1,287,379 | 12/1918 | Manown | 40/390 |
| 1,573,101 | 2/1926 | Steckol | 40/617 |
| 2,357,320 | 9/1944 | Fruitman | 40/390 |
| 2,566,837 | 9/1951 | Heulsmeyer | 40/11 R |
| 2,688,902 | 8/1954 | Becker | 408/120 |
| 3,145,326 | 8/1964 | McGannon | 40/530 |
| 3,184,067 | 5/1965 | Larter | 211/10 |
| 4,052,807 | 10/1977 | Schweinsberg | 40/390 |
| 4,132,022 | 1/1979 | Wood | 40/530 |

FOREIGN PATENT DOCUMENTS

| | | | |
|---|---|---|---|
| 1293560 | 2/1965 | Fed. Rep. of Germany | 40/606 |
| 2328649 | 6/1973 | Fed. Rep. of Germany | 40/607 |

*Primary Examiner*—Hugh R. Chamblee
*Assistant Examiner*—Wenceslao J. Contreras
*Attorney, Agent, or Firm*—Birch, Stewart, Kolasch & Birch

[57] ABSTRACT

The present invention is directed to a visible information management system which includes a notebook having disposed therein a plurality of pivotal passive pressure clips. Each of the pressure clips are adapted to hold therein an index card having information printed thereon. Each of the pressure clips may also be labeled in order that the cards held therein may be identified. The index cards are held in the pressure clips by virtue of an overlapping flap which forms a clip for holding under pressure an index card inserted therein. One side of the index card easily slips into the clip portion of the pivotal passive pressure clip. Since there are a plurality of pressure clips disposed in the notebook, a plurality of index cards may be slipped into the respective pressure clips within the notebook.

6 Claims, 8 Drawing Figures

VISIBLE INFORMATION MANAGEMENT SYSTEM

BACKGROUND OF THE INVENTION

1. Field of the Invention

The present invention generally relates to an indexing system or tickler system which includes a notebook or folder having a plurality of pivotal passive pressure clips disposed therein for easily holding a plurality of index cards or notes or reminders therein.

2. Description of the Prior Art

In certain work related activities, numerous tasks must be performed within a short period of time. In order to assist one in remembering these tasks and when they are to be performed, that is, to perform these tasks in a timely manner, various systems have been devised for aiding in remembering the various tasks and their specific dates when due. For example, in U.S. Pat. No. 1,287,379, to Manown, dated Dec. 10, 1918, a device is disclosed comprising a plurality of pivoted frames, each of which are capable of holding an entire note or card within the frame. However, this device is quite cumbersome since it is difficult to insert the note or card within the frame and to remove the note or card at will, especially when a large number of notes or cards must be inserted into and removed from their respective frames within a short period of time.

SUMMARY OF THE INVENTION

It is a primary object of the present invention to provide a visible information management system which performs the function of a note or card carrier for carrying a plurality of notes or cards therein, each of which are easily inserted into and removed from the carrier.

Another object of the present invention is to provide for a plurality of note carriers which include a plurality of pivotal passive pressure clips which are designed to hold a plurality of notes or index cards, respectively, for displaying a variety of information including numerous reminders and jobs to be performed within a certain time period.

A further object of the present invention is to provide a plurality of pivotal passive pressure clips in a notebook, wherein each of the pressure clips have an overlapping portion adapted to receive one edge of a note or an index card therein, whereby the note or card may be easily inserted into and removed from the pressure clip.

A further object of the present invention is to provide a plurality of pivotal passive pressure clips hinged to a substrate, the substrate having on its back surface thereof an adhesive coating and a peelable backing adhered to the coating, the backing being removable in order that the substrate may be adhesively secured to a wall, desk, notebook, folder or other structure.

These and other objects of the present invention will be accomplished by providing a notebook which has a wire disposed across a central portion thereof. Hinged or pivoted to the wire are a plurality of passive pressure clips. The upper portion of the clips are visible in order to view the index card placed therein to ascertain whether action is required. Each of these pressure clips have a label disposed on the upper portion thereof for labeling or otherwise indexing the note or index card held within the respective pressure clip. The label may include letters or numbers which may help to organize the index cards held within the pressure clips. Each of the pivotal, passive pressure clips include an overlapping portion which forms a clip, the clip being capable of holding therein under pressure, a note or index card which has been inserted thereinto. One edge of the index card is inserted into the clip. The overlapping portion of the clip securely holds the note or index card within the clip. The edge of the overlapping portion may be turned upwardly in order to facilitate the ease by which the one edge of the card is inserted into the clip portion of the pivotal passive pressure clip.

Alternatively, a plurality of passive pressure clips may be hinged or pivoted to a wire which is secured to a substrate. The substrate may be, for example, clear plastic, molded in the form of a parallelpiped. The back portion of the substrate has disposed thereon an adhesive coating. A peelable backing is secured to the coating and may be removed therefrom in order that the substrate may be secured to a wall, a desk, or other structure.

The index card or notes may be of varying sizes. The notebook may be a legal size or pocket size. In summary, the present invention represents a portable file or tickler system for office use.

Further scope of applicability of the present invention will become aparent from the description given hereinafter. However, it should be understood that the details of the description and the specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENT

Figure 1B:
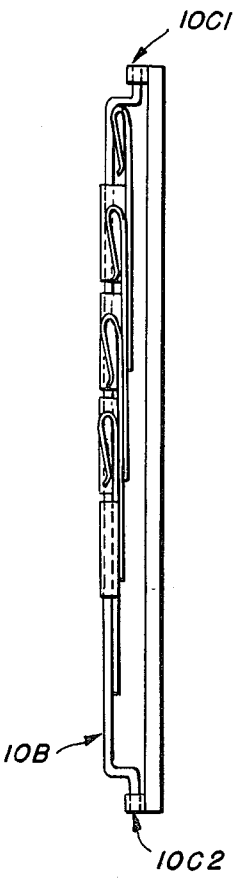
FIG. 1B is a side view of the notebook shown in FIG. 1A.
Figure 1A:
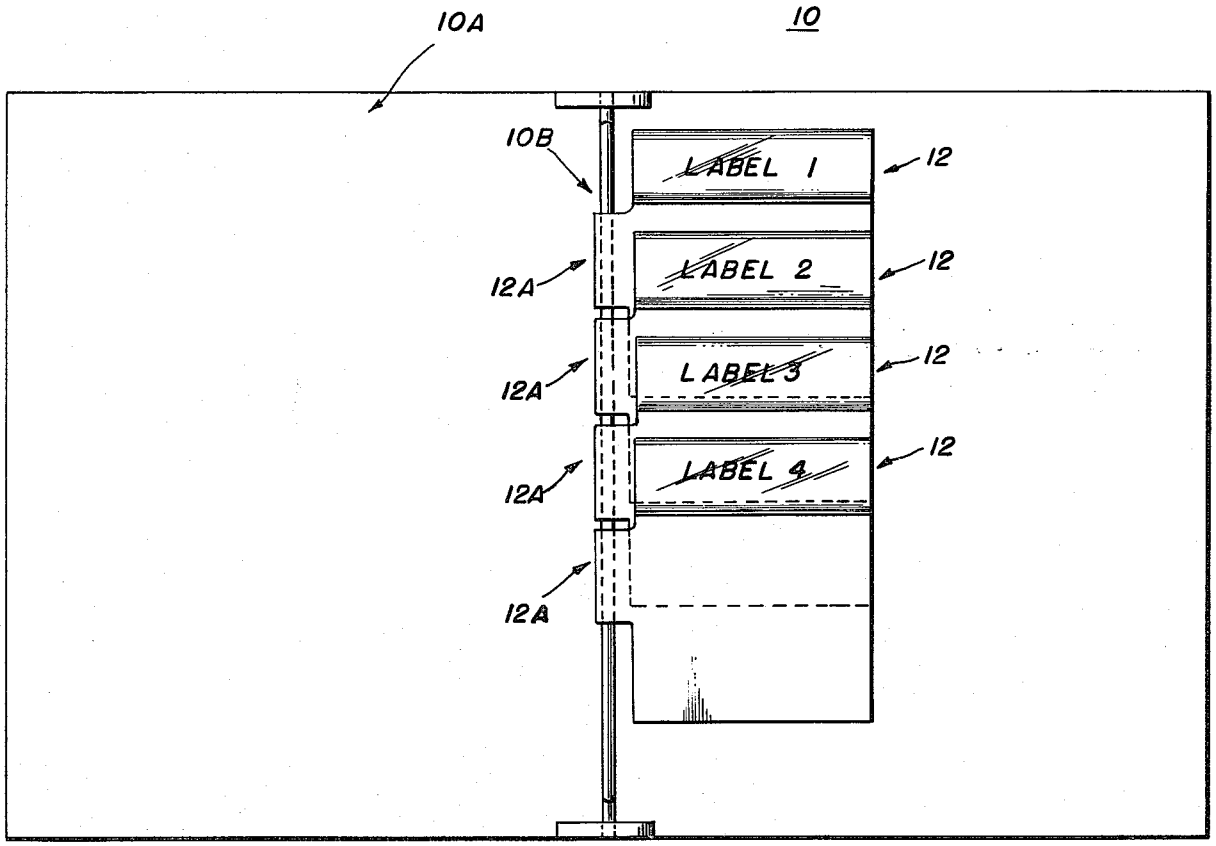
FIG. 1A is a top view of a notebook having disposed therein a plurality of pivotal passive pressure clips pivoted or hinged to a wire disposed across a central portion of a notebook.

Referring to FIGS. 1A and 1B, one embodiment of the visible information management system 10 of the present invention is illustrated. A notebook 10A has disposed along a central portion thereof, and along its fold line a wire 10B. As illustrated in FIG. 1B, the wire 10B is anchored at two ends 10C1 and 10C2. These ends, 10C1 and 10C2, are secured to the notebook 10A and provide an insert wherein the wire 10B is inserted thereinto.

As best seen in FIG. 1A, a plurality of pivotal passive pressure clips 12 are hinged to and pivot around the wire 10B. Each of the pivotal passive pressure clips 12 may have a label attached thereto. This label would identify the particular pressure clip to which the label is associated. The wire 10B passes through the sleeve portion 12A of the pressure clips for permitting the clips to pivot about the wire 10B.

Figure 2:
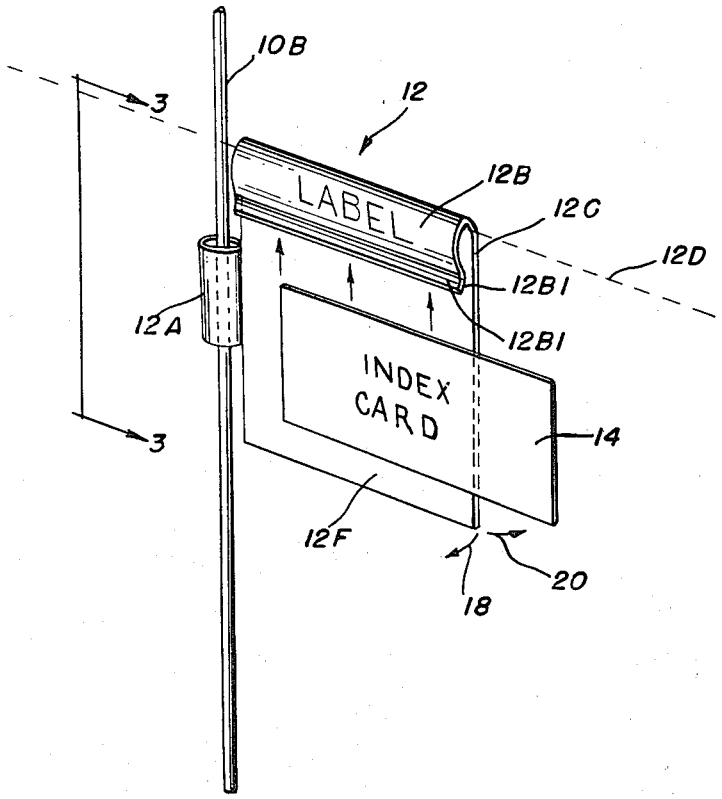
FIG. 2 is a perspective view of one of the pivotal passive pressure clips shown and illustrated in FIG. 1A.

A more detailed view of the pivotal passive pressure clips of the present invention can be seen in FIG. 2 from the drawings of the present application. Referring to FIG. 2, each of the pressure clips include a sleeve portion 12A which enables the pressure clip 12 to pivot about the wire 10B. The pressure clip further includes an overlapping portion 12B and a back portion 12C, the overlapping portion 12B being bent along line 12D forming a pressure clip. The pressure clip is represented by the combined structure of the back portion 12C and the overlapping portion 12B. The overlapping portion 12B further includes a raised portion 12B1 disposed along the edge of the overlapping portion 12B.

An index card 14 is adapted to be inserted within the pressure clip of the present invention. The card 14 is inserted underneath the overlapping portion 12B, and specifically, underneath the raised portion 12B1 of the overlapping portion 12B. The card is inserted under the overlapping portion until it comes into contact with the upper surface of the pivotal passive pressure clip 12, the upper surface being generally indicated along line 12D as shown in FIG. 2 of the drawings.

Figure 3:
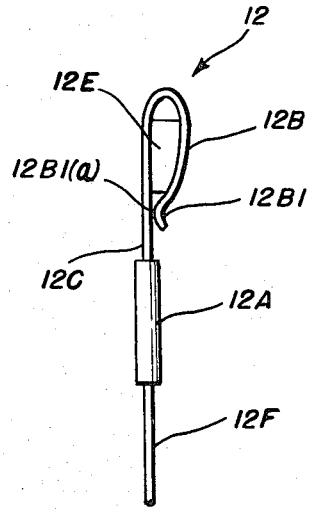
FIG. 3 is a side view of the pivotal passive pressure clip taken along section 3—3 of the FIG. 2.

Referring to FIG. 3, a side view of the pivotal passive pressure clip 12 of the present invention is illustrated, taken along section lines 3—3 of FIG. 2. The pressure clip 12 further includes an integral portion 12E which is integrally connected with the overlapping portion 12B on one end and the back side surface 12C of the pressure clip 12 on the other end. This integral portion 12E is used as a stop for preventing the index card from slipping out of one end of the pivotal passive pressure clip 12 after the card is inserted beneath the overlapping portion 12B of the pressure clip 12.

Figure 4:
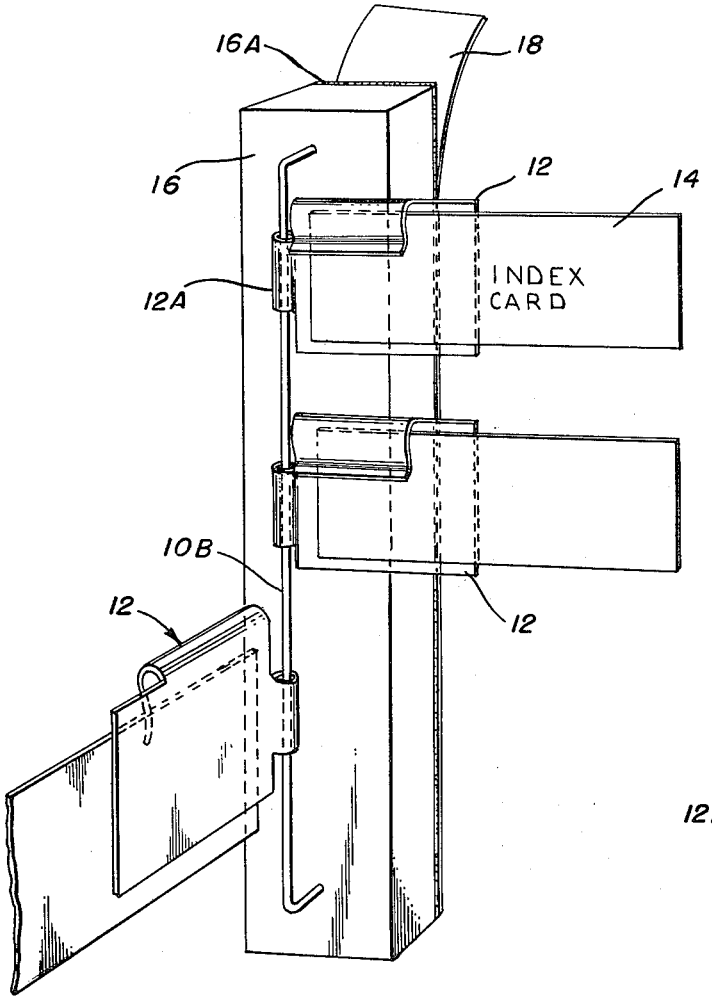
FIG. 4 is a perspective view of another embodiment of the present invention wherein the plurality of pivotal passive pressure clips are hinged or pivoted to a wire which is disposed within a substrate, the back portion of the substrate having an adhesive coating disposed thereon and peelable backing is disposed over the coating and may be removed in order that the substrate may be secured to a wall, a desk, or other structure.

Referring to FIG. 4, another embodiment of the present invention is shown. A plurality of pivotal passive pressure clips 12 are again illustrated. The sleeve 12A of the pressure clips 12 enables the clip to pivot about a wire 10B. However, the wire 10B is anchored at two ends to a substrate 16. The substrate 16 may be, for example, clear plastic material shaped in the form of a parallelepiped. The back surface of the substrate 16 has disposed thereon an adhesive layer 16A consisting of any well known adhesive material. A peelable backing 18 is adherred thereto and is adapted to be removed from the adhesive layer 16A of the substrate 16 thereby exposing the adhesive layer. When the peelable backing 18 is removed, the substrate 16 can then be secured to a wall, a desk, or similar structure.

Figure 5A:
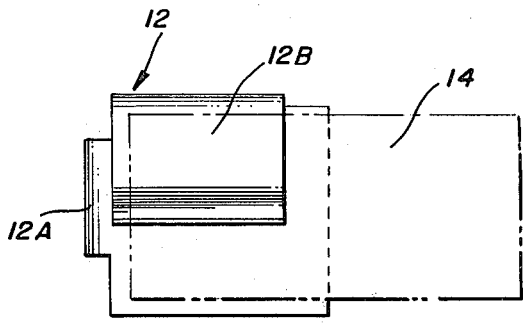
FIG. 5A is a top view, in a larger perspective, of the pivotal passive pressure clip used and illustrated in the embodiment of the invention shown on FIG. 4.
Figure 5B:
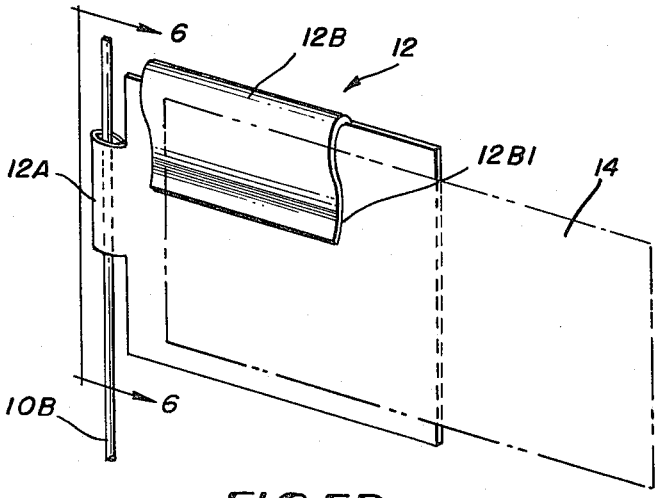
FIG. 5B is a perspective three-dimensional view of the pivotal passive pressure clip shown in FIG. 5A.

Each of the pivotal passive pressure clips 12 shown in FIG. 4 are adapted to be pivoted about the wire 10B in the same manner as that which was illustrated with respect to the invention shown in FIG. 1 of the drawings. An index card 14 is adapted to be inserted underneath the raised portion 12B1 of the overlapping portion 12B of the pressure clips 12. See FIG. 5A of the drawings wherein a larger top view of the pivotal passive pressure clips 12 shown in FIG. 4 of the drawings is illustrated. An index card 14 is inserted underneath the overlapping portion 12B of the pressure clip 12. As can be seen in FIG. 5B of the drawings, the overlapping portion 12B further includes the raised portion 12B1 for aiding in the insertion of the card into the pivotal passive pressure clip 12. The sleeve portion 12A, seen in FIG. 5B, enables the pressure clip to pivot about the wire 10B shown in FIG. 4.

Figure 6:
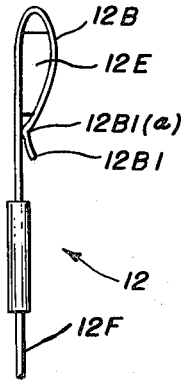
FIG. 6 is a side view of the pivotal passive pressure clip shown in FIG. 5B taken along section lines 6—6 of FIG. 5B.

Referring to FIG. 6, a side view of the pivotal passive pressure clip 12 shown in FIG. 5B of the drawings is illustrated, taken along section lines 6—6 of FIG. 5B. The pressure clip 12 further includes an integral portion 12E similar to the integral portion 12E shown in FIG. 3 of the drawings. The integral portion 12E acts a stop means for preventing the index card 14 from slipping out of the pressure clip 12 when the card is inserted underneath the overlapping portion 12B of the pressure clip.

As can be seen in FIGS. 3 and 6, the raised portion 12B1 is concave in shape. The apex **12B1(*a*) of the concave shaped raised portion 12B1 is in contact with the front surface 12F of the pivotal passive pressure clip 12. As a consequence of this, the overlapping portion 12B exerts a slight pressure on the front surface 12F of the pivotal passive pressure clip such that the apex 12B1(*a*) comes into contact with the front surface 12F. As a result, an index card 14, inserted underneath the raised portion 12B1 of the overlapping portion 12B will be held within the pressure clip by virtue of the pressure exerted by the apex 12B1(*a*) on the card 14, the card 14, in turn, exerting a pressure on the front surface 12F of the pivotal passive pressure clip 12. Therefore, the index card 14 will be firmly held within the clip portion of the pivotal passive pressure clip 12**.

In operation, referring to FIG. 1A, the pivotal passive pressure clip 12 is adapted to pivot about the wire 10B within the notebook 10A. The lowermost pressure clip 12 is pivoted counterclockwise about the wire 10B. The next lowermost pressure clip can then be pivoted counterclockwise about wire 10B. This action is followed by the pivoting of the next lowermost pivotal passive pressure clip about the wire 10B. Since each of the pivotal passive pressure clips may be labeled, the contents of the information on the index card 14 inserted within the respective pressure clip can be identified. As can be seen in FIG. 2, arrow 18 represents the counterclockwise pivoting direction of the pressure clip, and arrow 20 represents the clockwise pivoting direction of the pressure clip 12. The index card 14 is inserted, along one edge only, within the clip portion of the pivotal passive pressure clip. This is accomplished by inserting the one end to the index card underneath the raised portion 12B1 of the overlapping portion 12B until the one end of the index card comes into contact with the front surface 12F of the pressure clip disposed along line 12D shown in FIG. 2 of the drawings. The integral portion 12E will prevent the index card 14 from slipping out of the pressure clip 12, along a left hand direction relative to the pressure clip shown in FIG. 2.

Since the apex 12B1(*a*) of the raised portion 12B exerts a pressure of the front surface 12F of the pivotal passive pressure clip 12, the index card 14 will be firmly held within the pressure clip 12 by virtue of this pressure. As can be seen in FIG. 4 of the drawings, if one desires, the peelable backing 18 may be removed from the substrate 16 exposing the adhesive layer 16A which is coated on the entire back surface of the substrate 16. Then, the substrate 16 may be secured to a wall, a desk, or similar structure. Index cards 14 may then be inserted into and/or removed from the pivotal passive pressure clips 12 as desired. Since the pivotal passive pressure clips 12 are adapted to pivot about the wire 10B, as shown in FIG. 4, an ease of access is created whereby anyone of the pressure clips 12 may be used for the purpose of inserting an index card 14 therein containing desired information printed thereon.

The present invention enables one to remind himself of various jobs to be performed within a working time period by inserting index cards into the pivotal passive pressure clips of the present invention and exposing the information printed on the index cards. Once the job is performed, the index card is easily removed from its pivotal passive pressure clip permitting one to insert therein another index card having other information printed thereon. The index cards are easily inserted into and easily removed from their respective pressure clips.

The invention being thus described, it will be obvious that the same may be varied in many ways. Such variations are not to be regarded as a departure from the spirit and scope of the invention and all such modifications as would be obvious to one skilled in the art are intended to be included within the scope of the following claims.

I claim:

1. A visible information management system adapted to firmly hold a plurality of cards therein and to enable the easy removal of said cards therefrom for replacement thereof, comprising:

a plurality of pressure clip means for holding the respective cards therein, each of the pressure clip means including, a back side surface for providing a support surface for one of said cards held by the pressure clip means, an overlapping means integrally connected to said back side surface along a top edge thereof for receiving said respective cards therein and for exerting pressure on said cards when said cards are inserted therein, a plate integrally connecting said back side surface to said overlapping means are disposed approximately perpendicularly to said back side surface along a side edge thereof for preventing said one of said cards from slipping out of a side end of the pressure clip means after the card has been inserted beneath said overlapping means, and sleeve means integrally connected to said back side surface along said side edge thereof for enabling said pressure clip means to pivot about a longitudinal axis passing through said sleeve means; and securing means disposed along said longitudinal axis and passing through each of said sleeve means of said plurality of pressure clip means for securing each of said pressure clip means in place along said longitudinal axis thereby permitting said pressure clip means to pivot clockwise and counterclockwise about said longitudinal axis.

2. A visible information management system in accordance with claim 1 wherein said overlapping means comprises a bent portion of the respective pressure clip means, an edge of said bent portion being disposed very near a front surface of the respective pressure clip means, only one edge of the respective corresponding card being insertable underneath the edge of the bent portion of said overlapping means.

3. A visible information management system in accordance with claim 2 wherein said securing means comprises a wire disposed along said longitudinal axis and passing through each of said sleeve means of said plurality of pressure clip means.

4. A visible information management system in accordance with claim 3 further comprising a notebook having said wire disposed along a longitudinal axis thereof, said wire securing said plurality of pressure clips means therein, said plurality of pressure clip means pivoting about said wire in said notebook.

5. A visible information management system in accordance with claim 3 further comprising a substrate having a front surface and a rear surface, said substrate having said wire disposed along a longitudinal axis on the front surface thereof, said wire securing said plurality of pressure clip means thereon, said pressure clip means pivoting about said wire on said substrate, said substrate further including an adhesive coating disposed over the rear surface thereof.

6. A visible information management system in accordance with claim 5 further comprising a peelable backing secured to said adhesive coating on said rear surface of said substrate, said peelable backing being removable from said rear surface of said substrate.

* * * * *